US010537146B2

(12) United States Patent
De Arquer Recio et al.

(10) Patent No.: US 10,537,146 B2
(45) Date of Patent: Jan. 21, 2020

(54) SUPPORT FOR HELMETS

(71) Applicant: Luis De Arquer Recio, Barcelona (ES)

(72) Inventors: Luis De Arquer Recio, Barcelona (ES); Sergi Nolla Juan, Barcelona (ES)

(73) Assignee: Luis De Arquer Recio, Barcelona (ES)

( * ) Notice: Subject to any disclaimer, the term of this patent is extended or adjusted under 35 U.S.C. 154(b) by 0 days.

(21) Appl. No.: 15/740,788

(22) PCT Filed: Jun. 28, 2016

(86) PCT No.: PCT/EP2016/065055
§ 371 (c)(1),
(2) Date: Dec. 28, 2017

(87) PCT Pub. No.: WO2017/001427
PCT Pub. Date: Jan. 5, 2017

(65) Prior Publication Data

US 2018/0184742 A1 Jul. 5, 2018

(30) Foreign Application Priority Data

Jun. 29, 2015 (ES) ..... 201530758 U

(51) Int. Cl.
*A42B 3/00* (2006.01)
*A42B 3/04* (2006.01)

(52) U.S. Cl.
CPC ..... *A42B 3/006* (2013.01); *A42B 3/044* (2013.01)

(58) Field of Classification Search
CPC .... A42B 3/006; A42B 3/044; F16M 2200/08; F16M 11/22; F16M 11/00; F16M 13/80; B65D 19/0002
USPC ..... 248/176.1, 346.01, 346.03, 346.5, 154
See application file for complete search history.

(56) References Cited

U.S. PATENT DOCUMENTS 2,665,872 A * 1/1954 De Witt ..... A47G 29/093 119/14.1
5,395,086 A * 3/1995 Goldstein ..... A47G 23/03 248/146
5,651,651 A * 7/1997 Spencer ..... F16B 41/005 411/372.6
6,454,105 B1 * 9/2002 Medina ..... A63B 71/0045 211/14
6,527,241 B1 * 3/2003 Lord ..... G06F 1/203 248/346.01
7,167,358 B2 * 1/2007 Iwasaki ..... G06F 1/1601 248/917

(Continued)

FOREIGN PATENT DOCUMENTS

DE 202007004555 U1 5/2007
EP 2614737 A1 7/2013

(Continued)

*Primary Examiner* — Nkeisha Smith
(74) *Attorney, Agent, or Firm* — Knobbe, Martens, Olson & Bear, LLP

(57) ABSTRACT

The invention relates to a support for helmets formed from a single body defining an upper surface (1) provided with adhesive that can be fixed to the outside of a helmet and a lower surface (2), wherein said body comprises three legs (3, 4) attached to one another at one of their ends, defining a Y shape. Preferably, the angle of separation (β) between two of said legs is 90° and the angle of separation (α) with the other leg is 135°.

Said support allows assuring the stability of a helmet when it is placed on a planar surface with the support, since said three legs act like a tripod.

19 Claims, 4 Drawing Sheets

(56) References Cited

U.S. PATENT DOCUMENTS 7,258,312 B2 * 8/2007 Grosse ..... B01F 15/00733 248/154
7,500,570 B2 * 3/2009 Kurcheski ..... A63B 47/00 211/14
7,726,621 B1 * 6/2010 Dellinger ..... B44D 3/14 220/737
7,830,661 B2 * 11/2010 Sween ..... G06F 1/203 248/346.01
7,992,831 B2 * 8/2011 Fan ..... B60R 11/00 248/205.5
8,350,486 B2 * 1/2013 Bucalo ..... H05B 33/0803 315/209 R
8,448,912 B2 * 5/2013 Kantarovich ..... A47G 1/22 248/216.1
8,573,797 B2 * 11/2013 Spartano ..... H01M 10/44 362/105
8,646,737 B1 * 2/2014 Sharpless ..... B01F 15/00733 108/55.1
8,690,379 B2 * 4/2014 Canella ..... F21L 4/00 362/200
D711,644 S * 8/2014 Leach ..... D3/257
9,285,657 B2 * 3/2016 Maltese ..... G03B 17/561
2004/0051021 A1 * 3/2004 Micheel ..... G10D 13/026 248/346.01
2005/0151044 A1 * 7/2005 Settele ..... A47J 36/34 248/346.01
2005/0194508 A1 * 9/2005 Furlong ..... F16M 11/22 248/346.01
2015/0197367 A1 * 7/2015 Edwards ..... B65D 19/0095 248/346.01
2017/0208889 A1 * 7/2017 Husain ..... A63B 71/081

FOREIGN PATENT DOCUMENTS

FR 2759259 A1 8/1998
FR 2777164 A1 10/1999
FR 3005241 A1 11/2014
WO 2010/140172 A1 12/2010

* cited by examiner

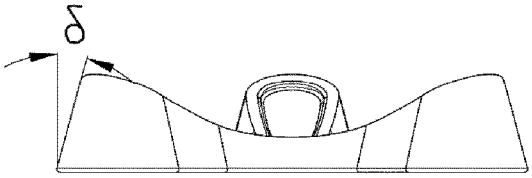
FIG. 3
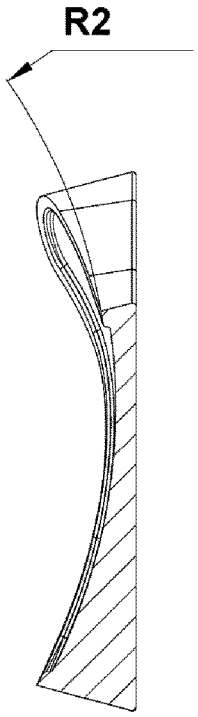
FIG. 4
FIG. 2
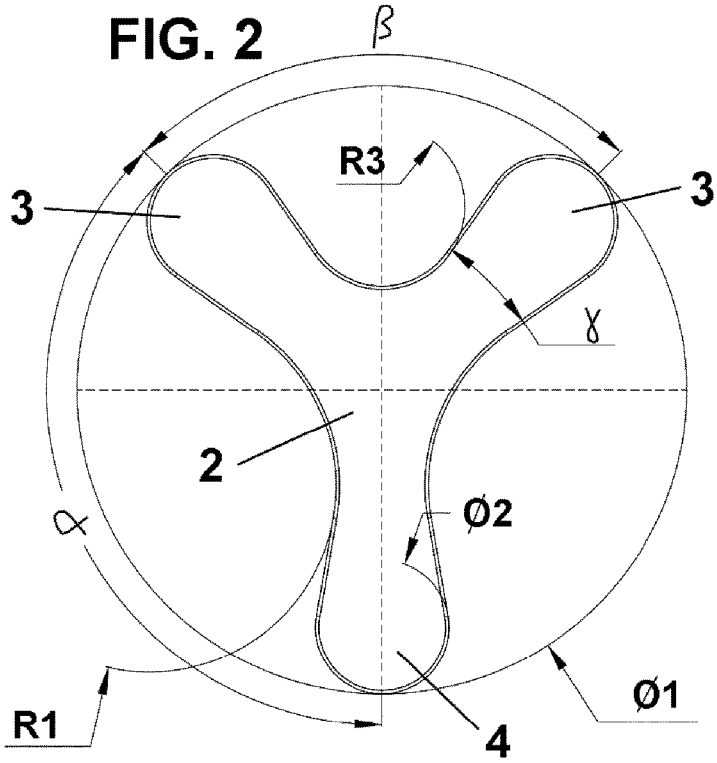
FIG. 6
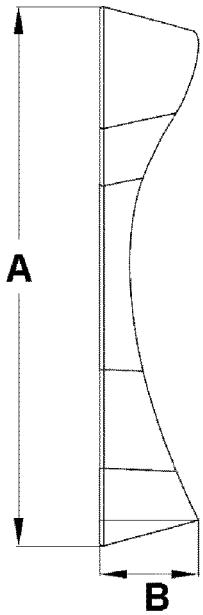
FIG. 5
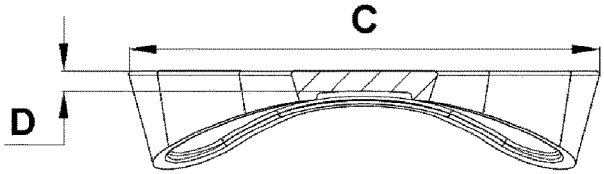

SUPPORT FOR HELMETS

CROSS-REFERENCE TO RELATED APPLICATIONS

This application is the U.S. National Phase under 35 U.S.C. § 371 of International Application PCT/EP2016/065055, filed Jun. 28, 2016, which claims priority to Spanish Application No. U201530758, filed Jun. 29, 2015. The disclosures of the above-described applications are hereby incorporated by reference in their entirety.

The present invention relates to a support for helmets, particularly to a support that can be fixed to a helmet by means of adhesive for placing the helmet in a stable manner on a horizontal surface.

BACKGROUND OF THE INVENTION

Helmets are formed by a shell the outer surface of which is curved and provided with an opening for users to introduce their heads.

When the helmet is not in use, it is frequently placed on a planar surface, for example, a table. However, due to the shape of helmets, their stability on said planar surface is not suitable, and the helmet can move involuntarily.

Supports for helmets which try to provide stability to the helmet when it is placed on a planar surface, formed by adhesive bodies which are fixed to the outer surface of the helmet are known.

A support for helmets of this type is described in patent document WO2010140172A1, the support of which is formed by several bodies which are fixed on the outer surface of the helmet, projecting from same. This support described in this patent document has the drawback that it requires the bodies being fixed in the suitable position to perform its support function, since if they are placed incorrectly they do not allow stable support of the helmet. Furthermore, these bodies project too far from the surface of the helmet, taking into account that these bodies are still in their position when the helmet is in use.

Another support of this type is described in patent document FR3005241A1, which discloses a disc-shaped support formed in a single part. The drawback of this support is that its adherence to the surface of the helmet may not be suitable due to the disc shape, such that the support can become detached from the helmet over time. Furthermore, this support also has the drawback that projects too far from the surface of the helmet.

Therefore, the need for a support for helmets that can be securely adhered to the outer surface of the helmet and furthermore projects from same as little as possible, so as to not cause any discomfort during normal use of the helmet, is obvious.

DESCRIPTION OF THE INVENTION

The support for helmets of the invention solves the mentioned drawbacks, having other advantages that will be described below.

The support for helmets according to the present invention is formed from a single body defining an upper surface provided with adhesive that can be fixed to the outside of a helmet and a lower surface, and is characterized in that said body comprises three legs attached to one another at one of their ends, defining a Y shape.

As a result of this feature, stability of a helmet is assured when it is placed on a planar surface with the support according to the present invention, since said three legs act like a tripod.

According to one embodiment, the angle of separation between two of said legs is 90° and the angle of separation with the other leg is 135°, two of said legs being able to be shorter than the other leg. Particularly, the two shortest legs form the angle of separation of 90° and form the angle of separation of 135° with the longest leg.

Furthermore, the outer end of each leg is preferably wider than the rest of the leg, for example, the width of the outer end of each leg is comprised between 18 and 21 mm, and the outer end of each leg can define a circumference with a diameter comprised between 18 and 21 mm.

Advantageously, the upper surface, which will be in contact with the helmet, is curved, and the lower surface, which will be supported on a surface, is planar.

For example, the curvature of the upper surface is defined by a radius comprised between 80 mm and 90 mm.

According to a preferred embodiment, the thickness of the body ranges between 3 mm and 15 mm, the width of the body is comprised between 65 mm and 75 mm, and the length of the body is comprised between 75 mm and 85 mm. For example, the thickness of the body is of 3 mm in its thinnest part and of 14.6 mm in its thickest part, has a width of 69 mm and a length of 79.5 mm.

Advantageously, said body is made of a flexible plastic material, for example polyvinyl chloride, being able to have a hardness of 70±20 Shore A.

Furthermore, said body preferably comprises a rim lacking adhesive on its upper surface provided with adhesive to prevent dirt from adhering to the adhesive.

If desired, the support for helmets according to the present invention can also comprise at least one light source, for example one or more light-emitting diodes (LEDs), which are preferably housed inside the body and are visible through its lower surface, being powered by means of at least one battery.

In addition to providing a stable support as a result of the arrangement of the Y-shaped legs, the dimensions of the body forming the support according to the present invention allow optimizing its thickness, such that it is the lowest possible without losing stability.

BRIEF DESCRIPTION OF THE DRAWINGS

To better understand the description provided, drawings are attached in which a practical embodiment is schematically depicted only by way of a non-limiting example.

FIG. 2 is a bottom plan view of the support for helmets according to the present invention;

FIGS. 3 to 6 are side views of the support for helmets according to the present invention;

DESCRIPTION OF A PREFERRED EMBODIMENT

The support for helmets according to the present invention is formed from a body defining an upper surface 1 provided with an adhesive, which will be fixed to a helmet, and a lower surface 2 which will be placed on a planar surface, such as a table.

Figure 1:
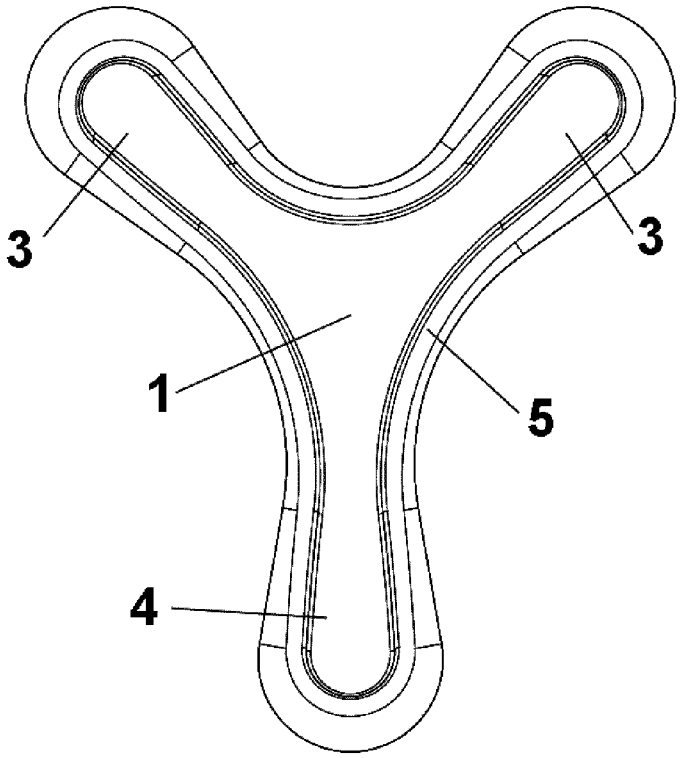
FIG. 1 is a top plan view of the support for helmets according to the present invention.

As can be seen in FIGS. 1 and 2, the body comprises three legs 3, 4 defining a Y shape, two legs 3 having the same length and a leg 4 having a longer length, which are attached to one another at one of the ends thereof.

The support therefore has a tripod shape, allowing great stability of the helmet on a planar surface.

As can be seen in FIGS. 1 and 2, the shorter legs 3 having the same length define a 90° angle with one another, and define a 135° angle with the other leg 4 having a longer length.

Furthermore, the width of the legs 3, 4 is greater at the outer end thereof than in the rest of the leg, for example, this width is 20 mm, preferably defining a circumference of 20 mm in diameter.

As can be seen in FIGS. 3 to 6, the lower surface 2 is planar and the upper surface 1 is curved for being able to adapt to any curvature of the helmet. Furthermore, to prevent the accumulation of dirt, the upper surface 1 comprises a rim 5 lacking adhesive.

The body forming the support according to the present invention is advantageously made of a flexible plastic material, such as, for example, polyvinyl chloride, with a hardness of 70±20 Shore A.

Figure 7:
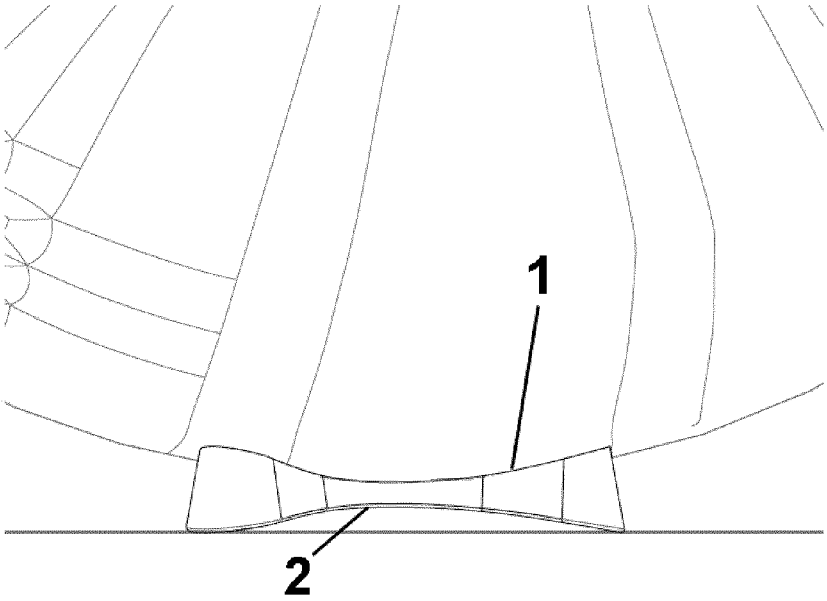
FIG. 7 is a side view of the support according to the present invention fixed in a helmet.

It should be indicated that although the lower surface 2 is planar in its rest position, before the support is fixed to the helmet, when it is fixed to a helmet, and as a result of the flexible nature of the material forming the body, said lower surface 2 is curved, as can be seen in FIG. 7.

FIGS. 2 to 6 indicate the specific dimensions of a non-limiting embodiment of the support for helmets according to the present invention. According to this embodiment, the indicated dimensions are the following:

A (length)=79.43 mm
B (maximum thickness)=14.60 mm
C (width)=69.19 mm
D (minimum thickness)=3.00 mm
R1=27.44 mm
R2=85.00 mm
R3=12.18 mm
$\alpha$=135°
$\beta$=90°
$\gamma$=20°
$\delta$=15°
$\phi$=89.70 mm
$\phi$=19.70 mm It should be indicated that the lower surface 2 can be printed, for example, with a name or logotype, for advertising purposes, or it can include reflective or phosphorescent material for safety purposes, since this lower surface 2 will be visible during normal use of the helmet.

Figure 8:
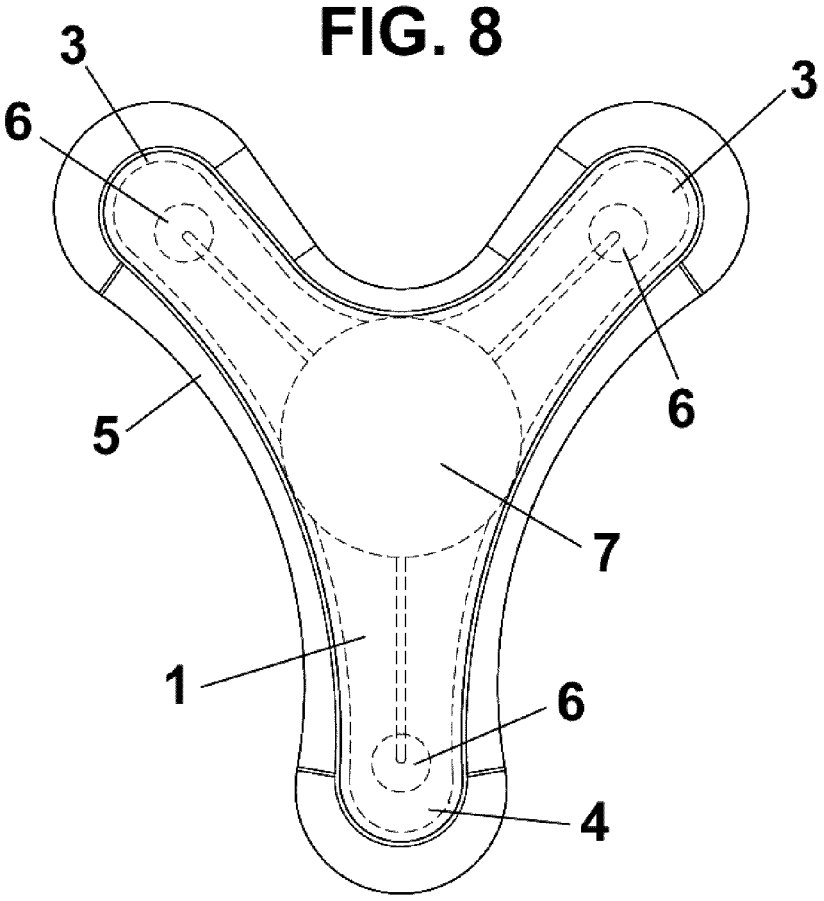
FIG. 8 is a top plan view of the support for helmets according to the present invention, including lighting.

According to the embodiment shown in FIG. 8, the support for helmets can also comprise lighting, specifically at least one light source 6. In the depicted embodiment, the support comprises three light sources 6, one close to the end of each leg 3, 4. This lighting allows the driver of a vehicle behind the user of the helmet with the support according to the present invention to be aware of the presence of said user, improving safety.

The light sources 6 are preferably light-emitting diodes (LEDs), although they could be any suitable light sources, which are housed inside the body and visible through its lower surface 2.

These light sources 6 are preferably powered by means of a battery 7, for example a button cell, also housed inside the body, and suitably connected with said light sources 6.

Despite having made reference to a specific embodiment of the invention, it is obvious for a person skilled in the art that the described support for helmets is susceptible to a number of variations and modifications, and that all the mentioned details can be replaced with other technically equivalent details without departing from the scope of protection defined by the attached claims.

What is claimed is:

1. A support for a helmet formed from a single body defining a curved upper surface provided with adhesive that can be fixed to an outside of a helmet and a lower surface,
wherein said body comprises three legs attached to one another at one of their ends, defining a Y shape,
wherein a thickness of a center portion of said body in a region where the three legs are attached is thinner than a thickness of said legs, and
wherein the lower surface is configured to be planar in a rest position and be curved when the upper surface is fixed to the helmet such that when the upper surface is fixed to the helmet the three legs turn down so as cooperate to form a tripod that supports the helmet and the center portion is supported above a bottom of the tripod.

2. The support for a helmet according to claim 1, wherein an angle of separation ($\beta$) between two of said legs is 90° and an angle of separation ($\alpha$) with other leg is 135°.

3. The support for a helmet according to claim 1, wherein an outer end of each leg is wider than rest of each leg.

4. The support for a helmet according to claim 3, wherein a width of the outer end of each leg is comprised between 18 and 21 mm.

5. The support for a helmet according to claim 4, wherein the outer end of each leg defines a circumference with a diameter comprised between 18 and 21 mm.

6. The support for a helmet according to claim 1, wherein two of said legs are shorter than other leg.

7. The support for a helmet according to claim 1, wherein a curvature of the upper surface is defined by a radius (R2) comprised between 80 mm and 90 mm.

8. The support for a helmet according to claim 1, wherein a thickness (B, D) of the body ranges between 3 mm and 15 mm.

9. The support for a helmet according to claim 1, wherein a width (C) of the body is comprised between 65 mm and 75 mm.

10. The support for a helmet according to claim 1, wherein a length (A) of the body is comprised between 75 mm and 85 mm.

11. The support for a helmet according to claim 1, wherein said body is made of a flexible plastic material.

12. The support for a helmet according to claim 11, wherein said body is made of polyvinyl chloride.

13. The support for a helmet according to claim 1, wherein said body has a hardness of 70±20 Shore A.

14. The support for a helmet according to claim 1, wherein said body comprises a rim lacking adhesive.

15. The support for a helmet according to claim 1, also comprising at least one light source.

16. The support for a helmet according to claim 15, wherein said at least one light source is housed inside the body and is visible through its lower surface.

17. The support for a helmet according to claim 15, wherein said at least one light source is powered by means of at least one battery.

18. The support for a helmet according to claim 1, wherein the thickness (B, D) of the body ranges between 3 mm and 15 mm.

19. The support for a helmet according to claim 1, wherein a curvature of the lower surface is in a direction opposite to a curvature of the upper surface when the upper surface is fixed to the helmet.

* * * * *